United States Patent [19]

Koehler

[11] Patent Number: 4,609,899

[45] Date of Patent: Sep. 2, 1986

[54] POLARIZED ELECTROMAGNET HAVING THREE STATES AND A CONTROL CIRCUIT FOR SAID ELECTROMAGNET

[75] Inventor: Gérard Koehler, Ville d'Avray, France

[73] Assignee: La Telemecanique Electrique, Nanterre, France

[21] Appl. No.: 756,511

[22] Filed: Jul. 18, 1985

[30] Foreign Application Priority Data

Jul. 20, 1984 [FR] France ..... 84 11517

[51] Int. Cl.[4] ..... H01F 7/08

[52] U.S. Cl. ..... 335/230; 335/81; 335/234; 361/208

[58] Field of Search ..... 335/78, 79, 80, 81, 335/229, 230, 234; 361/189, 208

[56] References Cited

U.S. PATENT DOCUMENTS

| | | | |
|---|---|---|---|
| 2,872,546 | 2/1959 | Babcock | 335/179 |
| 4,142,166 | 2/1979 | Arnoux | 335/81 |

FOREIGN PATENT DOCUMENTS

| | | | |
|---|---|---|---|
| 0078324 | 5/1983 | European Pat. Off. | 335/78 |
| 0086121 | 8/1983 | European Pat. Off. | 335/230 |
| 3138265 | 4/1983 | Fed. Rep. of Germany | 335/229 |
| 1067836 | 6/1954 | France | 335/229 |
| 2222746 | 10/1974 | France | 335/229 |
| 2532107 | 2/1984 | France | 335/229 |
| 0036109 | 4/1981 | Japan | 335/230 |

OTHER PUBLICATIONS

"La Telegraphe et le Telex", *Organes Constituties et Voies de Transmission,* D. Faugeras, Ed. Eyrolles 1962, p. 194.

*Primary Examiner*—George Harris
*Attorney, Agent, or Firm*—Young & Thompson

[57] ABSTRACT

A three-state polarized electromagnet comprises a stationary system (1) surrounded by a coil (5) and a moving system (7). Each system consists of a permanent magnet (2; 14) fitted with pole pieces (3, 4; 12, 13). The ends of the pole pieces are bent-back towards each other in order to define four air-gaps (E1 to E4) for permitting displacement of the moving system (7) between two end positions. One end portion of a pole piece forms part of only one air-gap and the air-gap faces are joined to pole faces of permanent magnets having the same polarity in order to reduce to zero the fluxes within the air-gaps which are closed when no excitation is applied and in order to permit a return to a stable central position.

10 Claims, 6 Drawing Figures

POLARIZED ELECTROMAGNET HAVING THREE STATES AND A CONTROL CIRCUIT FOR SAID ELECTROMAGNET

BACKGROUND OF THE INVENTION

1. Field of the Invention

The present invention relates to a three-state electromagnet and to a control circuit for said electromagnet.

2. Description of the Prior Art

Three-state electromagnets are useful for example for controlling an equipment unit or device between a quiescent state and two different operating states. By way of example, an electromagnet of this type can be mounted in a contactor for putting a three-phase motor in forward motion, in reverse motion or in the stationary state. A contactor of this type comprises contacts of the changeover type which are also capable of assuming an intermediate position between the two end positions. In order to prevent any short-circuiting of the source during the passage of electric arcs across the contacts, it must be ensured that the speed of changeover of the contacts is not too high.

A known form of polarized contactor having three stable positions has already been disclosed in German patent DE A1 No. 31 38 265 and in French patent FR-A No. 2 532 107. This contactor comprises an electromagnet of the bistable type having a permanent magnet and a restoring spring which is totally inactive in the central position of the armature but produces an abrupt variation as soon as the armature moves away from its central position. The permanent magnet ensures stability of each end position in spite of the opposing action of the spring.

This known contactor is thus tristable. However, applications involving the use of monostable contactors are more common. Furthermore, in order to leave an end position, the coil must be excited in a direction opposite to that of the preceding excitation. At this stage, however, the armature is liable to pass beyond the stable central position and to move right up to the other end position. Instead of stopping, the controlled motor will rotate in the opposite direction, which is liable to be highly dangerous. It is in fact known that ampere-turns cannot easily be regulated by reason of the variations in voltage and resistance which are caused by heating. Furthermore, the force produced by the magnets varies with the temperature and the force exerted by the contact springs decreases with wear of the contacts.

In order to overcome this deficiency, the document of the prior art proposes to excite the windings simultaneously in opposite directions. Their total effect is then only the effect of leakages caused by the different positions of the windings, thus resulting in low efficiency. Furthermore, switching or changeover of the windings is difficult to carry out in practice. In addition, a stable central position cannot readily be obtained by means of a spring and makes it necessary to take practical precautions which entail high capital expenditure. By way of example, reference can be made in this connection to the book entitled "La Télégraphie et le Télex" by D. Faugeras, published in 1962 by Eyrolles, page 194: three-position relay.

Means for making the contactor monostable are admittedly proposed in one of the cited documents but these means are insufficient in actual practice.

As disclosed in patent EP - A No. 86 121, there is also known an electromagnet having two moving systems provided with permanent magnets and capable of relative displacement while defining four air-gaps between them. The permanent magnets are in series with each other at one end position which is therefore stable and are in opposition to each other at the other end position which is therefore unstable. An electromagnet of this type is in fact monostable without artifice. But if it is employed in a contactor, the electromagnet is capable of placing the power contacts only in two different positions and not three.

French patent FR No. 2 554 957 (not published on the priority date of the present Application) describes an electromagnet which is of the same type (with two positions and two permanent magnets) but is bistable.

Another known device disclosed in U.S. Pat. No. 2,872,546 is a three-position monostable electromagnet in which a rotating permanent magnet is mounted between two fixed magnets, the midpoint of each fixed magnet being joined to one end of a fixed yoke. When no excitation is applied, the moving magnet assumes an intermediate position in which its north pole is at equal distance from the north poles of the fixed magnets and its south pole is located at equal distance from the south poles of the fixed magnets. The moving magnet pivots either in one direction or in the other, depending on the direction of excitation of a coil which surrounds the yoke. However, this electromagnet is inefficient since the only practical effect of the coils is to suppress certain repulsive forces while allowing others to remain.

It is in fact known that, repulsive forces are weaker than attractive forces in closed air-gaps.

The object of the invention is thus to propose a three-position monostable electromagnet which develops high magnetic forces in the "work" positions, which is not liable to move from one end position to the other when it has been operated solely for a return to the central or intermediate position, which does not require any costly modification such as an increase in range of travel or in inertia of the moving system and which is not liable to change-over too rapidly from one end position to the other since this would entail the risk of a short-circuit.

SUMMARY OF THE INVENTION

The invention is thus directed to a polarized electromagnet comprising a magnetic circuit and at least one excitation coil surrounding a portion of the magnetic circuit. Said magnetic circuit is constituted by two systems each comprising at least one permanent magnet provided with pole pieces on its pole faces, the systems being capable of relative displacement between two end positions. The pole pieces of one system form in conjunction with the pole pieces of the other system two oppositely-acting pairs of variable air-gaps. Thus the air-gaps of one pair close when the air-gaps of the other pair open by reason of the relative displacement of the systems in a direction which is determined by the state of excitation of the coil.

In one of the pairs of air-gaps, each air-gap has opposite faces joined to pole faces of permanent magnets having the same magnetic polarity.

In accordance with the invention, each air-gap of the other pair of air-gaps has opposite faces joined to pole faces of permanent magnets having the same magnetic polarity. The sizes of the permanent magnets are chosen so as to have the effect, on the one hand when no excitation is applied to the coil, of substantially reducing to zero the flux which passes through a closed air-gap and thus making it possible to restore the systems to an intermediate position between the two end positions and on the other hand, when excitation is applied to the coil, of producing an attraction towards either of the two end positions according to the direction of excitation of said coil.

In a preferred embodiment of the invention, the air-gaps are formed by end portions of the pole pieces and each end portion aforesaid forms part of only one air-gap.

In consequence, when each system is located in one end position with respect to the other and the current supply is interrupted, the electromagnetic force of attraction is suppressed and repulsive forces then appear as in the "work" position of the contactor described in patent EP - A No. 86121. If the force chosen for the permanent magnets is of sufficiently high value with respect to any possible residual magnetism within the closed air-gaps, these repulsive forces restore the two moving systems to their intermediate relative position. It is also possible to choose weaker magnets in conjunction with resilient restoring means such as, for example, the elasticity of the power contacts if the electromagnet is employed in a contactor. It should be clearly understood that the restoring means considered here as a possible expedient have only an auxiliary function involving forces of low value in comparison with the electromagnetic forces and affording higher resistance to any vibrations in the intermediate position, the essential requirement being to suppress the electromagnetic force of attraction. In consequence, the restoring means under consideration are not required to produce high efforts for ensuring that the force of the permanent magnet is more than counterbalanced in order to avoid the risk of remanence.

Once they have been displaced from their relative end positions, the systems cannot travel beyond their intermediate relative position since symmetrical restoring forces appear beyond this latter position. The intermediate position is therefore stable. It is in this position that each magnet "sees" the lowest reluctance of the magnetic circuit to which it is subjected.

When an excitation is applied in a given direction, one of the systems moves with respect to the other towards an end position under the action of forces which are similar to those produced within the contactor in accordance with patent EP - A No. 86121. Since the differences between two magnet forces are stable in time and indifferent to temperature, the intermediate position is defined with precision and can be adjusted by selective demagnetization.

According to another aspect of the invention, the control circuit for the aforesaid electromagnet is distinguished by the fact that it comprises for at least one of the coil windings an assembly comprising a capacitor connectable in parallel with the winding, a resistor connected in series with said winding, a discharge resistor connectable in parallel with the capacitor, and a switching means movable between a first position in which a winding supply line and the capacitor are connected to a source terminal whilst the discharge resistor is disconnected, and a second position in which the capacitor is in series with the discharge resistor whilst the winding supply line is open.

Thus, in order to transfer the armature from one end position to the other, it is first necessary to interrupt the current supply to the winding in service and current is supplied to the winding equipped with the aforesaid assembly. The moving system is thus restored to the intermediate position. In a first stage, however, said moving system cannot move beyond this position. In fact, the voltage developed across the terminals of the winding considered increases at the same rate as the charge on the capacitor and it is only after a certain period of time or stationary period that said voltage is sufficient to cause displacement of the moving system to the other end position. With a control circuit of this type, a contactor in accordance with the invention permits a change in direction of rotation of a motor, for example, without any jerks or any potential danger of a short-circuit between phases. When the other winding aforesaid is put back into service, the capacitor discharges into the discharge resistor. The two windings can each be equipped with the above-mentioned assembly, in which case the operation described in the foregoing takes place each time the excitation is transferred from one winding to the other.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
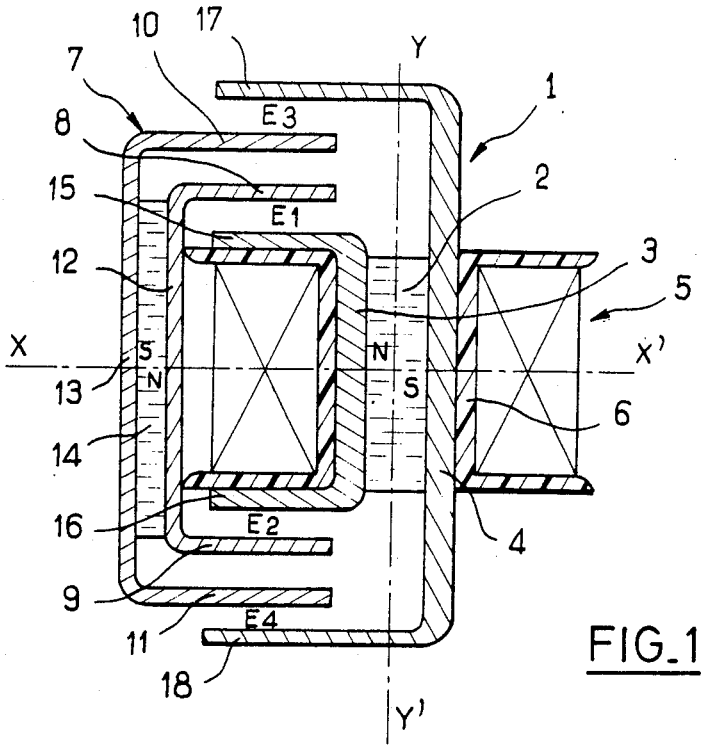
FIG. 1 is a sectional view taken along the axis of the coil of an electromagnet in accordance with the invention.
Figure 2:
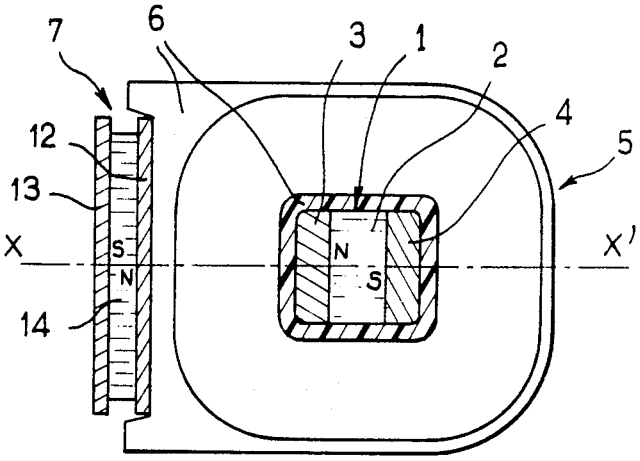
FIG. 2 is a sectional view of the electromagnet of FIG. 1, taken at right angles to the axis of the coil.

In the embodiment of FIGS. 1 and 2, the electromagnet comprises a stationary system 1 and a moving system 7. The stationary system 1 comprises a permanent magnet 2, the pole faces (N, S) of which are fitted respectively with pole pieces 3 and 4. A coil 5 wound on a coil form 6 surrounds the stationary system 1 in the central region in which the magnet 2 is located so as to ensure that the field of the coil along an axis Y-Y′ is perpendicular to the axis of magnetization X-X′ of the permanent magnet 2.

The moving system 7 further comprises a permanent magnet 14, the axis of magnetization of which is parallel to X-X′ and the pole faces (N, S) of which are fitted respectively with pole pieces 12 and 13.

The pole piece 3 has two end portions 15, 16 which extend outwards from the coil 5 and are bent back at right angles along the flanges of the coil form 6.

The pole piece 12 has two end portions 8, 9 which are bent back at right angles so as to be parallel to the end portions 15 and 16 and located externally of these latter. Thus a variable air-gap E1 is determined between the end portions 15 and 8 of the two systems and a variable air-gap E2 is determined between the end portions 16 and 9 of said systems.

The pole piece 13 has two end portions 10, 11 which are bent back at right angles so as to be parallel and located externally of the end portions 8 and 9.

Finally, the pole piece 4 has two end portions 17, 18 which extend outwards from the coil 5 and are bent-back at right angles so as to be parallel to the end portions 10 and 11 and located externally of these latter. Thus a variable air-gap E3 is determined between the end portions 10 and 17 of the two systems and a variable air-gap E4 is determined between the end portions 11 and 18 of said systems.

In a preferred embodiment of the invention, the moving system 7 is capable of translational displacement in a direction parallel to the axis of the coil. It is apparent from FIG. 2 that said moving system is guided by recesses formed in the flanges of the coil form 6.

In a first end position of the moving system 7, the air-gaps E1 and E4 are closed by bringing their opposite faces together whilst the air-gaps E2 and E3 are opened. In the other end position, the air-gaps E2 and E3 are closed whilst the air-gaps E1 and E4 are open.

The two pairs of air-gaps E1-E4 and E2-E3 therefore have actively opposing effects.

In accordance with the invention, the polarities of the permanent magnets 2 and 14 are chosen so as to ensure that the opposite faces of each air-gap are joined to permanent-magnet pole faces having the same polarity, namely the N (north) polarity in the case of the air-gaps E1 and E2 and the S (south) polarity in the case of the air-gaps E3 and E4.

This arrangement is made possible by the fact that each end portion of a pole piece forms part of only one air-gap whereas in the above-cited patent EP - A No. 86121, for example, certain ends of the pole pieces (9*a* and 9*b*) form part of two oppositely-acting air-gaps.

Again in accordance with the invention, the sizes of the permanent magnets (mainly their surface areas) are chosen so as to ensure that no magnetic flux passes through a closed air-gap when no excitation is applied to the coil 5. The end positions are thus prevented from being stable positions. Steps may even be taken to ensure that the weaker external reluctances are presented to the permanent magnets when the moving system 7 is in an intermediate position located substantially at the midpoint between end positions as shown in FIG. 1. To this end, it may prove an advantage to add permanent magnets in proximity to the air-gaps, for example between the parallel end portions 8 and 10 as well as between the end portions 9 and 11.

However, the sizes of the magnets (mainly their thickness) must also be chosen in accordance with the invention as a function of the ampere-turns of the coil in order that these latter should enhance one direction of passage of the flux of the permanent magnet 2 by passing around the permanent magnet 14 and by ensuring a sufficiently high "work" force within the pair of closed air-gaps, depending on the direction of excitation of the coil.

In practice, taking into account the dissymmetries between the two air-gaps of a pair of air-gaps, it is difficult to obtain a sufficiently high repulsive force and the central position can be ensured in a conventional manner by means of actively-opposing springs for producing action as soon as the moving system 7 moves away from its central position in either one direction or the other while also improving impact resistance.

In order to increase the "work" force, it may prove advantageous to increase the power of the permanent magnet 2, even if this gives rise to low flux within the closed air-gaps after interruption of current to the coil, the corresponding residual force being readily compensated by a spring which is stretched at the end of travel; this force may partly result from the compressive force of contacts.

The operation of said electromagnet is therefore of the monostable type, starting from a stable central position. The direction of displacement of the moving system to one of the end positions depends on the direction of excitation of the coil. Interruption of current to the coil causes suppression of at least the greater part of the electromagnetic work forces. Return to the central position may be assisted by springs if necessary. The work forces can be of high value since the entire flux of the permanent magnet 2 is switched by the coil 5 into closed air-gaps whereas, in U.S. Pat. No. 2,872,546, for example, practically the sole action of the coils is to suppress certain repulsive forces while allowing others to remain.

Furthermore, by making provision for added pole pieces, the invention makes it possible to produce sufficiently high work forces without, however, allowing the presence of residual forces.

As will readily be apparent, the invention is not limited to the structure described in the foregoing and any number of structural modifications may be contemplated without thereby departing from the scope of the invention.

Thus the stationary and moving portions can be changed over by sliding the system 1 within the coil form 6, the flanges of which are nearer to each other. It is also possible to dispense with certain bent-back end portions of pole pieces such as those designated by the references 15 and 16 in order to provide a bearing end-face of the pole piece.

The moving system 7 can also be displaced in pivotal motion through an angle of 90° about the axis which passes through the air-gaps, two moving systems being placed on each side of the coil 5 if necessary.

Figure 3:
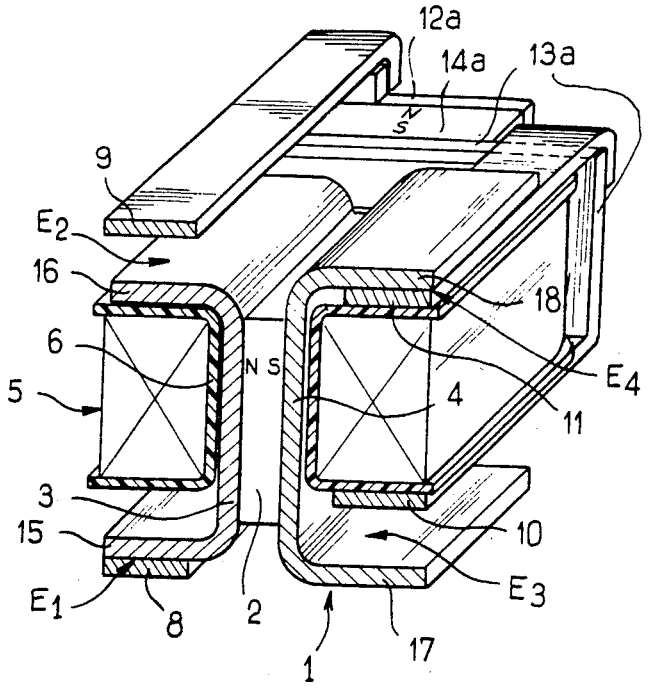
FIG. 3 is a sectional view in perspective showing another arrangement of an electromagnet in accordance with the invention.

Instead of bending-back the end portions of the pole pieces 3 and 4 on one and the same side of the axis Y-Y' of the coil 5, they can be bent-back on each side of said axis as illustrated in FIG. 3. In this figure, the system 1 is capable of displacement in sliding motion within the coil form 6 and the moving system 7 is split into two components, one of each side of the coil 5 (only the permanent magnet 14*a* together with its pole pieces 12*a*–13*a* is visible in the figure).

Figure 6:
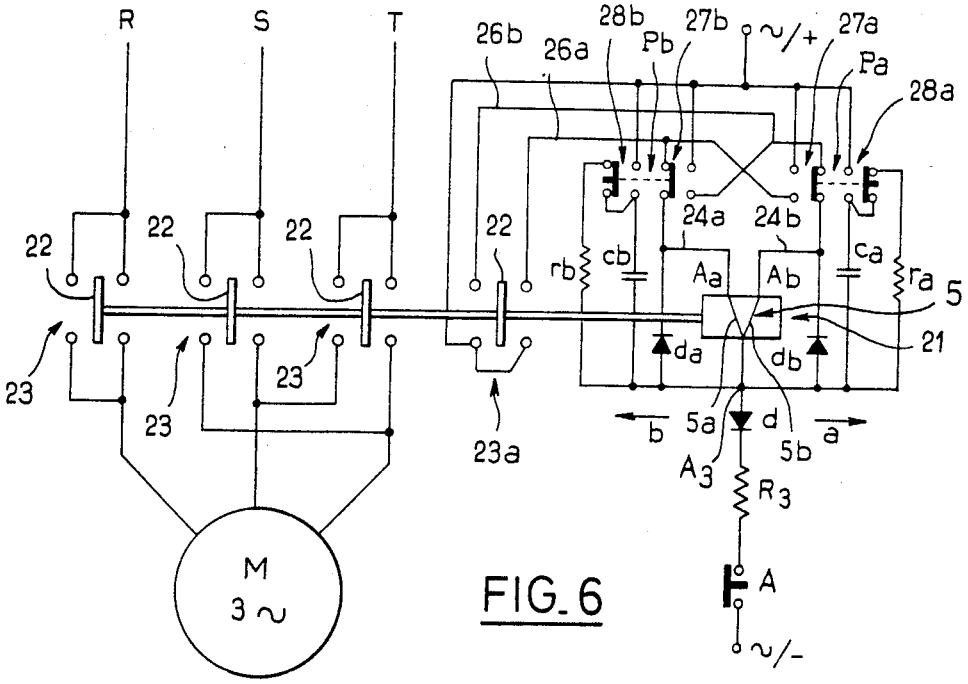

Instead of being bent back at right angles, the end portions of the pole pieces can also be flat or bent in the shape of a bayonet socket as shown in FIG. 6 of French patent FR- A No. 2,554,957 while maintaining the magnetic polarities.

Finally, instead of providing air-gaps closed by relative inward displacement of two faces having a constant surface area, provision can be made for air-gaps which have a constant air-gap distance but are closed by varying the zone of overlap of two opposite faces. In order to achieve such an arrangement, it is only necessary to ensure in FIG. 1 that the moving system 7 is capable of pivotal displacement about the axis X-X' whilst the air-gaps E1 to E4 have cylindrical surfaces which are given suitable relative angular positions.

Figure 4:
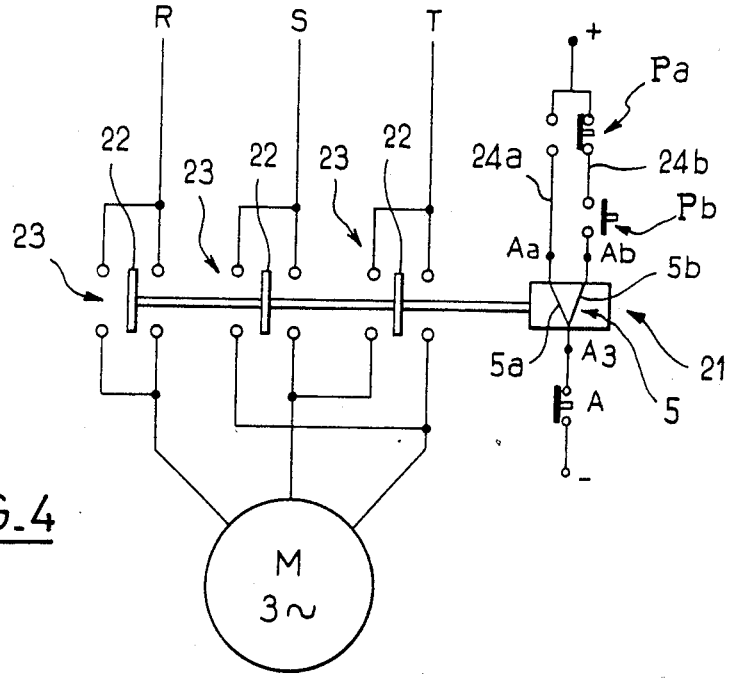
FIG. 4 is a circuit diagram of the electromagnet of FIGS. 1 to 3 in a contactor for forward-reverse-stop control of a three-phase motor.

There is shown in FIG. 4 the electromagnet 21 of FIGS. 1 and 2 in which the moving system is attached to the movable member 22 of three power contacts 23 of the changeover type. In other words, the movable member 22 of each contact 23 connects two separate and distinct pairs of stationary contacts according to the end position occupied by the moving system 7.

In the situation which is illustrated in the figure, the moving system 7 is in an intermediate position and the movable members 22 are also in an intermediate position in which no contact is established.

The contacts 23 are mounted between the terminals RST of a three-phase source and the terminals of a three-phase motor M in a conventional circuit arrangement such that the motor rotates in either one direction or the other according as the contacts 23 are in either one position or the other.

The coil 5 comprises two windings 5*a*, 5*b* (illustrated schematically) which are wound in such a manner as to generate fluxes of opposite direction when they are supplied with current. Said windings have a common termination A3 connected to the negative terminal of a direct-current source by means of an emergency-stop push-button control A.

The other two ends Aa, Ab of the windings 5*a*, 5*b* can be connected at will to the positive terminal of the direct-current source aforesaid by means of a supply line 24*a*, 24*b* respectively.

The line 24*a* associated with the winding 5*a* is adapted to carry the make contacts of a monostable manual switch Pa, the back contacts of which are on the line 24*b*. Said line 24*b* is also adapted to carry the make contacts of another monostable manual switch Pb.

In the quiescent state, neither of the windings 5*a*, 5*b* is supplied with current and the motor M remains stationary.

The motor M is driven in rotation either in one direction or in the other, depending on whether the push-button Pa or Pb is depressed. As soon as the push-button is released, the motor stops.

Figure 5:
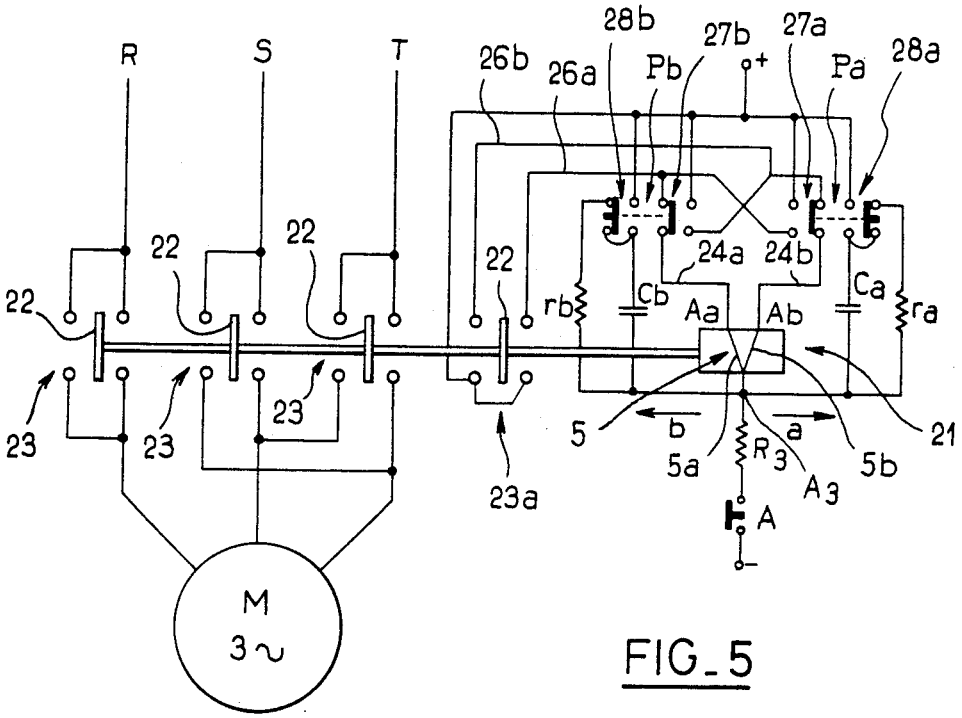
FIGS. 5 and 6 show the the contactor of FIGS. 1 to 3 associated respectively with two control circuits in accordance with the invention for the forward-reverse-stop control of a three-phase motor.

The circuit of FIG. 5 constitutes an improvement over the arrangement of FIG. 4 and is associated with a contactor which is similar to that of FIG. 4 except for the fact that it comprises an additional changeover contact designated by the reference 23*a*. The movable member 22 of said contact is rigidly fixed to the movable members 22 of the contacts 23. The input terminal of each stationary contact of the contact 23*a* is connected to the positive terminal of the supply source. Each output terminal is connected to a respective line 26*a* or 26*b*. The line 26*a* is connected to the line 24*a* which passes through a back contact of a changeover element 27*b* of the switch Pb. Similarly, the line 26*b* is connected to the line 24*b* which passes through a back contact of a changeover element 27*a* of the switch Pa. As can be verified by means of the arrows a and b which show respectively the direction in which the windings 5*a* and 5*b* produce action on the movable members 22, the arrangement is such that the self-supply line 26*a* or 26*b* which is closed by the contact 23*a* always has the function of supplying current to the winding 5*a* or 5*b*, the action of which maintains the movable members 22 in the position occupied by these latter.

Furthermore, in parallel with the contact 23*a*, the lines 24*a* and 24*b* are connected to the positive terminal of the current source via a make contact of the changeover elements 27*a* and 27*b* respectively.

There is associated with each winding 5*a* or 5*b* an assembly comprising a capacitor Ca or Cb mounted between the node A3 and the positive terminal of the source, in series with a make contact of a second changeover element 28*a* or 28*b* of the changeover switch Pa or Pb respectively. In parallel with each capacitor Ca or Cb is mounted a discharge resistor ra or rb in series with a back contact of the second changeover element 28*a* or 28*b*. A resistor R3 which is common to the two assemblies is mounted between the node A3 and the stop button A.

The operation takes place as follows:

Assuming that the motor is rotating in the direction determined by the winding 5*a*, the moving system of the contactor is in the right-hand end position (arrow a) and the winding 5*a* is self-supplied via the contact 23*a* and the line 26*a*, the push-buttons of the switches Pa or Pb having been released. Each capacitor Ca or Cb is in a loop circuit which is closed on its discharge resistor ra or rb and therefore has no effect on the control.

In order to change the direction of rotation, the push-button Pb is depressed. This has several effects. In the first place, the changeover element 27*b* opens the self-supply circuit of the winding 5*a*. The same change-over element closes the direct connection between the line 24*b* and the positive terminal of the current supply source. At the same time, the changeover element 28*b* connects the capacitor Cb in parallel with the winding 5*b* and cuts the resistor rb out of circuit.

As soon as its self-supply circuit is interrupted, the winding 5*a* is de-energized and permits the return of the moving system to the intermediate position. In a first stage, the moving system does not pass beyond this position. In fact, since the other winding 5*b* has been connected in parallel with the capacitor Cb and in series with the resistor R3, its voltage rise takes place with a time constant (R3, Cb) of 1 s., for example, and preferably of more than 0.2 s. It is only after a predetermined time interval that the magnetic force produced by the winding 5*b* is sufficient to displace the moving system to its other end position on the left-hand side, thus permitting startup of the motor in the other direction.

The example of FIG. 6 is similar to that of FIG. 5 except for the fact that, in order to take advantage of the presence of the capacitors by permitting the supply of alternating current, a half-wave rectifier diode d has been interposed between the node A3 and the resistor R3. In addition, each winding 5*a* or 5*b* is mounted in parallel with a free-wheel diode da or db with which the winding 5*a* or 5*b* forms a closed circuit when the winding is disconnected, in which case the forward direction of the diode corresponds to the normal direction of current flow within the winding as is permitted by the diode d.

The resistor R3 avoids the use of excessively fine winding wires in the case of an alternating-current voltage of 220 V and the low power which is necessary for control of the electromagnet dispenses with the need for a large-size resistor R3.

The components ra, rb, Ca, Cb and R3 and the diodes which may be provided can readily be housed within a casing having the same profile as the contactor (snap-fastening on a bar, similar terminals, etc.) or within a casing snap-fastened on the contactor body as a standard ancillary unit.

In the case of automatic control, the push-buttons Pa and Pb can be replaced by a single set of changeover contacts with or without self-supply while nevertheless retaining time-control of reversal of the directions of rotation of the controlled motor.

The electromagnet described in the foregoing can also be employed in a three-way electrovalve.

What is claimed is:

1. A polarized electromagnet comprising at least one excitation coil (5) and a magnetic circuit constituted by two systems (1, 7) each comprising at least one permanent magnet (2, 14) provided with pole pieces (3, 4; 12, 13) on its pole faces, the coil (5) being adapted to surround one of the systems in a region comprising the permanent magnet, said systems (1, 7) being capable of relative displacement between two end positions, the pole pieces (3, 4) of one system (1) being adapted to form with the pole pieces (12, 13) of the other system (7) two oppositely-acting pairs of variable air-gaps (E1, E4; E2, E3), the air-gaps of one pair being adapted to close when the air-gaps of the other pair open by reason of the relative displacement of the systems in a direction which is determined by the state of excitation of the coil (5), the opposite faces of one pair of air-gaps (E1, E4) being joined to pole faces of permanent magnets having the same magnetic polarity, wherein the opposite faces of the other pair of air-gaps (E2, E3) are joined to pole faces of permanent magnets having the same magnetic polarity, and wherein the sizes of the permanent magnets (2, 14) are chosen so as to have the effect, on the one hand, when no excitation is applied to the coil (5), of substantially reducing to zero the flux which passes through a closed air-gap and thus making it possible to restore the systems to an intermediate relative position between the two end positions and on the other hand, when excitation is applied to the coil (5), of producing an attraction towards either of the two end positions according to the direction of excitation of the coil (5).

2. An electromagnet according to claim 1, wherein the air-gaps (E1, E2, E3, E4) are formed by end portions (8, 9, 10, 11, 15, 16, 17, 18) of the pole pieces (3, 4, 12, 13) and wherein each pole-piece end portion forms part of only one air-gap (E1, E2, E3, E4).

3. An electromagnet according to claim 2, wherein the ends (8, 9, 10, 11, 15, 16, 17, 18) of pole pieces (3, 4, 12, 13) are bent-back at right angles so as to be parallel to each other.

4. An electromagnet according to claim 3, wherein closing of the air-gaps (E1, E2, E3, E4) is obtained by moving the opposite air-gap surfaces towards each other, said surfaces being transverse to the axis (Y-Y') of the coil (5) in such a manner as to ensure that the relative movement of the systems (1, 7) is a movement of translation in a direction parallel to the axis (Y-Y') of the coil (5).

5. An electromagnet according to claim 4, wherein said electromagnet comprises resilient restoring means.

6. A contactor comprising an electromagnet according to claim 5 and power contacts (23) of the changeover type in which the state is determined by the relative positions of the moving systems of the electromagnet, wherein the restoring means comprise the elasticity of the power contacts (23).

7. A control circuit for an electromagnet according to claim 6, wherein the coil (5) comprises two windings (5*a*, 5*b*) which are wound so as to generate fluxes of opposite direction, wherein said circuit comprises for at least one of the coil windings an assembly comprising a capacitor (Ca, Cb) connectable in parallel with the winding, a resistor (R3) connected in series with said winding, a discharge resistor (ra, rb) connectable in parallel with the capacitor (Ca, Cb) and a switching means (Pa, Pb) movable between a first position in which a supply line (24*a*, 24*b*) for the winding (5*a*, 5*b*) and the capacitor are connected to a source terminal whilst the discharge resistor is disconnected, and a second position in which the capacitor is in series with the discharge resistor whilst the winding supply line is open.

8. A control circuit according to claim 7, wherein said circuit comprises an assembly as mentioned above for each winding, the first position of each switching means being unstable and the second position being stable.

9. A control circuit according to claim 8, wherein said circuit comprises means for connecting the windings to the source via a contact of the changeover type (23*a*) controlled by the relative position of the moving systems and, in the case of each winding (5*a*, 5*b*) via a contact (27*a*, 27*b*) which is closed in the quiescent state and forms part of the switching means (Pb, Pa) assigned to the other winding (5*b*, 5*a*) in order to provide a control of the self-supply type.

10. A control circuit according to claim 9 and connectable to an alternating-current supply source, wherein a half-wave rectifier diode (d1) is mounted in series with the two windings (5*a*, 5*b*) and wherein each winding (5*a*, 5*b*is mounted in parallel with a free-wheel diode (d2, d3).

* * * * *